US009194675B1

(12) United States Patent
Manole et al.

(10) Patent No.: US 9,194,675 B1
(45) Date of Patent: Nov. 24, 2015

(54) TRAINING (REUSEABLE), AND TACTICAL (GUIDANCE ADAPTABLE), 40 MM PROJECTILE

(71) Applicants: Leon Manole, Great Meadows, NJ (US); Arthur Ricardo Pizza, Maywood, NJ (US); Ernest Lee Logsdon, Newton, NJ (US); Gary Anthony Pacella, Stroudsburg, PA (US); Anthony J. Sebasto, Budd Lake, NJ (US); Wilfredo Toledo, Hasbrouck Heights, NJ (US); John Shelp, Cresco, PA (US)

(72) Inventors: Leon Manole, Great Meadows, NJ (US); Arthur Ricardo Pizza, Maywood, NJ (US); Ernest Lee Logsdon, Newton, NJ (US); Gary Anthony Pacella, Stroudsburg, PA (US); Anthony J. Sebasto, Budd Lake, NJ (US); Wilfredo Toledo, Hasbrouck Heights, NJ (US); John Shelp, Cresco, PA (US)

(73) Assignee: The United States of America, as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/589,326

(22) Filed: Jan. 5, 2015

Related U.S. Application Data

(63) Continuation-in-part of application No. 13/761,861, filed on Feb. 7, 2013, now abandoned.

(60) Provisional application No. 61/601,609, filed on Feb. 22, 2012.

(51) Int. Cl.
*F42B 8/20* (2006.01)

(52) U.S. Cl.
CPC ..... *F42B 8/20* (2013.01)

(58) Field of Classification Search
CPC ..... F42B 8/20; F42B 8/18; F42B 8/14
USPC ..... 102/473, 439, 483, 524, 526, 527, 444, 102/529, 445
See application file for complete search history.

(56) References Cited

U.S. PATENT DOCUMENTS

| | | | | |
|---|---|---|---|---|
| 6,571,715 | B1 * | 6/2003 | Bennett et al. | 102/439 |
| 6,588,700 | B2 * | 7/2003 | Moore et al. | 244/3.28 |
| 2014/0331884 | A1 * | 11/2014 | Willhelm et al. | 102/439 |

* cited by examiner

*Primary Examiner* — Reginald Tillman, Jr.
(74) *Attorney, Agent, or Firm* — Michael C. Sachs

(57) ABSTRACT

Shown is a family of low spin and essentially no spin, full in-bore 40 mm projectiles which can be fired from a standard M203 or M320 grenade gun launcher. The projectiles have extended range through over 1000 meters and also have the capability for adding on guidance-navigation and control features/components for great accuracy. Increased accuracy is also provided by another, rear fin type projectile embodiment. The projectiles can be lengthened to accommodate more lethal fragments, and increased amount of explosive and energetic. At the same time, there is provided a training round of analogous performance for all these tactical projectiles.

9 Claims, 4 Drawing Sheets

TRAINING (REUSEABLE), AND TACTICAL (GUIDANCE ADAPTABLE), 40 MM PROJECTILE

CROSS REFERENCE TO RELATED APPLICATIONS

This application is a continuation-in-part of commonly assigned application Ser. No. 13/761,861 filed Feb. 7, 2013 of same title and same inventors, which parent application in itself claims benefit under 35 USC §119 (e) from provisional application 61/601,609 filed Feb. 22, 2012 the entire file wrapper contents of all of which applications are hereby incorporated by reference as though fully set forth.

U.S. GOVERNMENT INTEREST

The inventions described herein may be made, used, or licensed by or for the U.S. Government for U.S. Government purposes.

BACKGROUND OF INVENTION

This round enables a projectile to be fired, but without imparted spin, from a M203/M320 grenade Launcher. This is an achievement since the barrel of the M203/M320 is rifled, which ordinarily would spin up a projectile (such as the typically used M433 HE Dual Purpose projectile) as it travels down the barrel tube, and the projectile would leave the gun tube with a high spin rate, for spin stabilization. Eliminating this spin is an achievement because the projectile could then be fitted with guidance/control which would greatly enhance the performance of the projectile. However, to add such guidance/control the projectile must not be spinning. Instead, fins will subsequently be used here (after launch) for fin stabilization.

The M203/M320 are not stand alone gun launchers, but are used by attachment to an M16 or M4 rifle, for instance. They can then fire a family of 40 mm low velocity projectile rounds. In order to load a 40 mm round into an M203, the forward sleeve of the gun tube is slid forward, and a 40 mm round is pushed into the sleeve. The sleeve is then slid backwards and locked into position, ready to fire. The barrel of the M203 is rifled, which spins up the projectile as it travels down the barrel tube, and the projectile leaves the gun tube with a high spin rate. The area of rifling is approximately six inches in length.

Projectiles currently used in M203/M320 grenade launchers include the M433 High Explosive Dual Purpose Round, the M406 High Explosive Round, M583A1 Star Parachute Round, M585 White Star Cluster Round, M713 Ground Marker Round, M781 Practice Round, M651 CS Round, and the M576 Buckshot Round.

The 40 mm cartridge case is typically not reused or recycled after firing. If the cartridge case becomes stuck in the gun tube, there is a tool to help the war-fighter push it from the tube. The M320 fires the same 40 mm low velocity ammunition as the M203. There are several improvements that the M320 has compared to the M203. The M320 has stand alone single shot capability and may be fired by the war-fighter without attaching to a gun. it also has the capability to be attached to and fired from the M16/M4 rifle, similarly to the M203. A major improvement of the M320 is the ability of the firing tube to open sideways. By opening sideways, longer ammunition can be loaded into the M320 gun tube as compared to loading in an M203. While the approximate maximum length of the projectile is approximately five inches in the M203, projectiles several inches longer can be loaded into an M320. Both M203 and M320 have rifled barrels which induce spinning in the projectile as it travels through the gun tube.

There exists a great need to develop a new family of 40 mm projectiles that can extend range through increased velocity and projectile shape to over 1000 meters; to have the capability for adding on optional guidance navigation and control features/components; to increase projectile length to accommodate more lethal fragments and increased amount of explosive and energetic; and; to increase lethality through enhanced precision and more accurate strikes. At the same time, it is necessary to provide a training projectile that flies similarly to the tactical projectile, which will allow a war-fighter the opportunity to train with a realistically similar flying projectile that performs analogously to its actual tactical projectile equivalent. The training projectile can also be equipped with an inert florescent powder where upon ground or target impact, the projectile releases the powder to imitate an explosion. When the projectile is needed for battle, it is equipped instead with a fuze, explosive, shape charge liner and/or warhead, and it is equipped to defeat a target upon impact. Additionally, optional guidance and control components/features can be added to the front or side of this projectile utilized for battle. The optional guidance and control features provide increased accuracy and more precision hits on targets up to and beyond 1000 meters (a goal which is sought). Guided ammunition would need to have no spin (or very little spin) so that the seeker or camera therein, for instance, can see the target clearly while in flight. The conventional M203 or M320 grenade launcher guns have internal rifling intended to spin up the projectiles (at approximately 1800 revolutions per second) for stabilization of flight. Clearly then, a way must be found to avoid the spin which is inherent in conventional M203 or M320 grenade launcher guns when optional guidance is desired to be added to the projectile.

BRIEF SUMMARY OF INVENTION

An entirely new round is presented for use in the M203 or M320 Grenade Launchers which will accomplish all the above mentioned goals. The included projectile will not be appreciably spun up by the launcher barrel rifling at all. This in-flight projectile is arranged to be decoupled from its rear holding cup assembly and rear obturator, so it won't spin. The new in-flight projectile of this invention will further provide for a new family of 40 mm projectiles that can extend range through increased velocity and optimized projectile shape by over 600 to 1000 meters. It will also have the capability for adding on optional guidance and control components/features to the front or side of this projectile utilized for battle. The optional guidance and control features provide increased accuracy and more precision hits on targets up to and beyond 1000 meters (a goal which is sought). Guided ammunition needs to have no spin (or very little spin) so that the seeker or camera therein, for instance, can see the target clearly while in flight-this invention fully satisfies this requirement.

This invention also can allow for an increase in projectile length to accommodate more lethal fragments and increased amount of explosive and energetic. The invention will therefore increase lethality through enhanced precision and more accurate strikes. At the same time, this invention will also allow a war-fighter the opportunity to train with a realistically similar flying projectile that performs analogously to its actual tactical projectile equivalent. It has similar shape, weight, and flies like the tactical projectile. It also may provide florescent powder for training, substituted for the energetic items otherwise used for actual battle operations. The inert florescent powder would be released upon ground or target impact and the powder would imitate an explosion. When the projectile is needed for battle on the other hand, it is equipped instead with a fuze, explosive, shape charge liner and/or warhead, and it is equipped to defeat a real target upon impact.

LIST OF DRAWINGS

DESCRIPTION OF THE INVENTION

Figure 1:
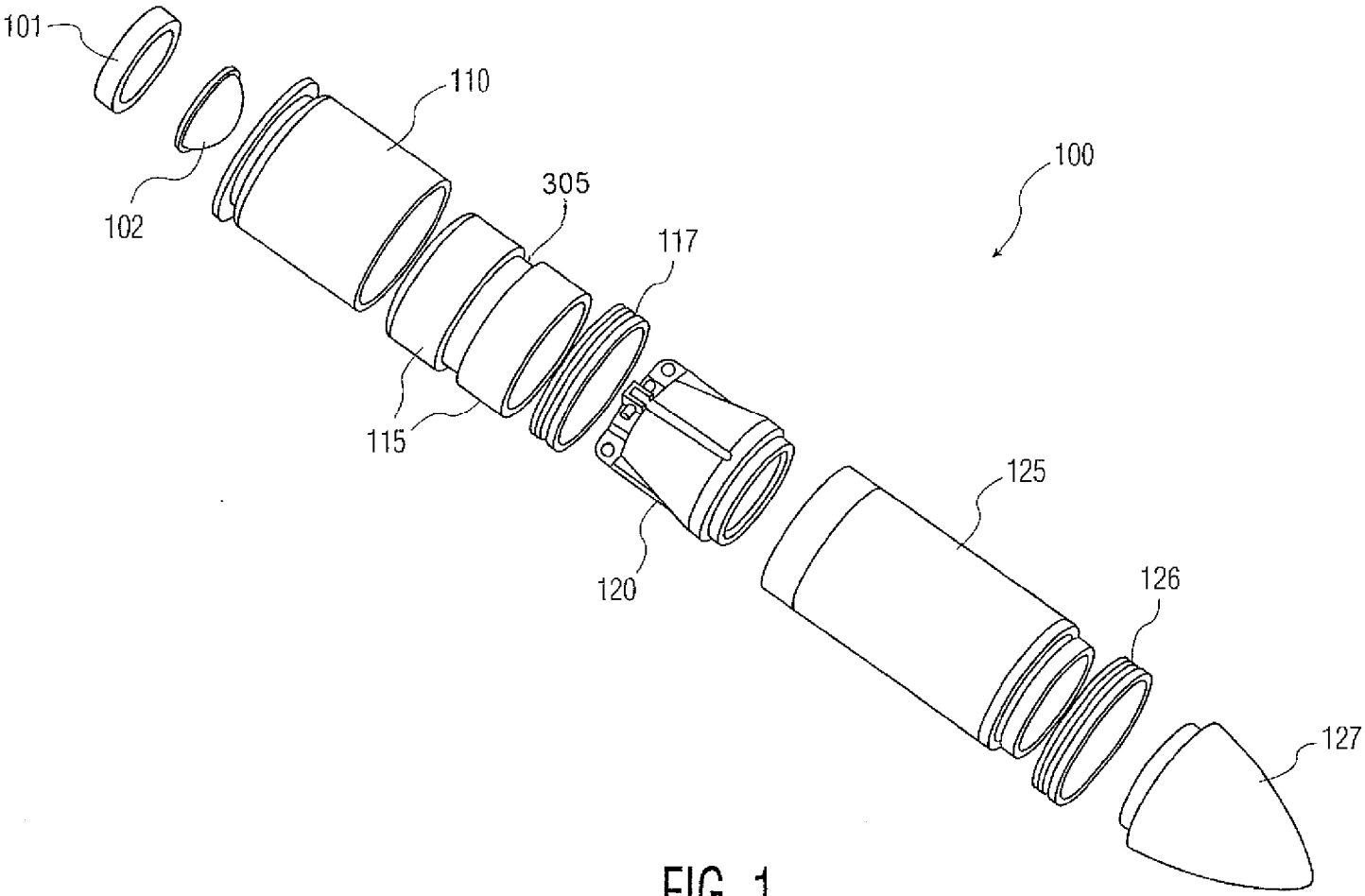
FIG. 1 shows a cutaway model of a 40 mm novel training (re-useable) and tactical (guidance adaptable) 40 mm projectile cartridge with rear holding cup shown, according to this invention.
Figure 2:
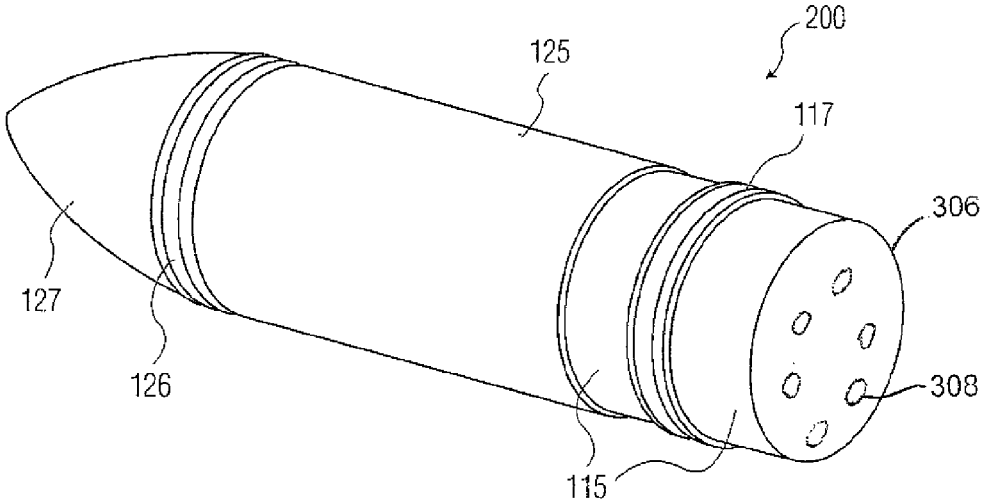
FIG. 2 shows a rear view of an assembled model of a 40 mm novel training (re-useable) and tactical (guidance adaptable) 40 mm projectile cartridge with rear holding cup shown, according to this invention.
Figure 3:
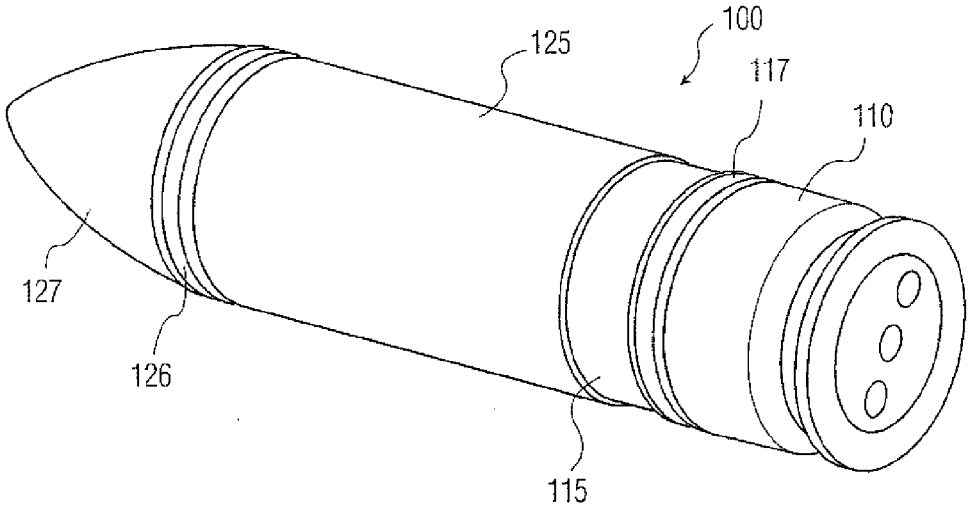
FIG. 3 shows a model view of an assembled 40 mm novel training (re-useable) and tactical (guidance adaptable) 40 mm projectile cartridge with cartridge case shown, according to this invention.
Figure 4:
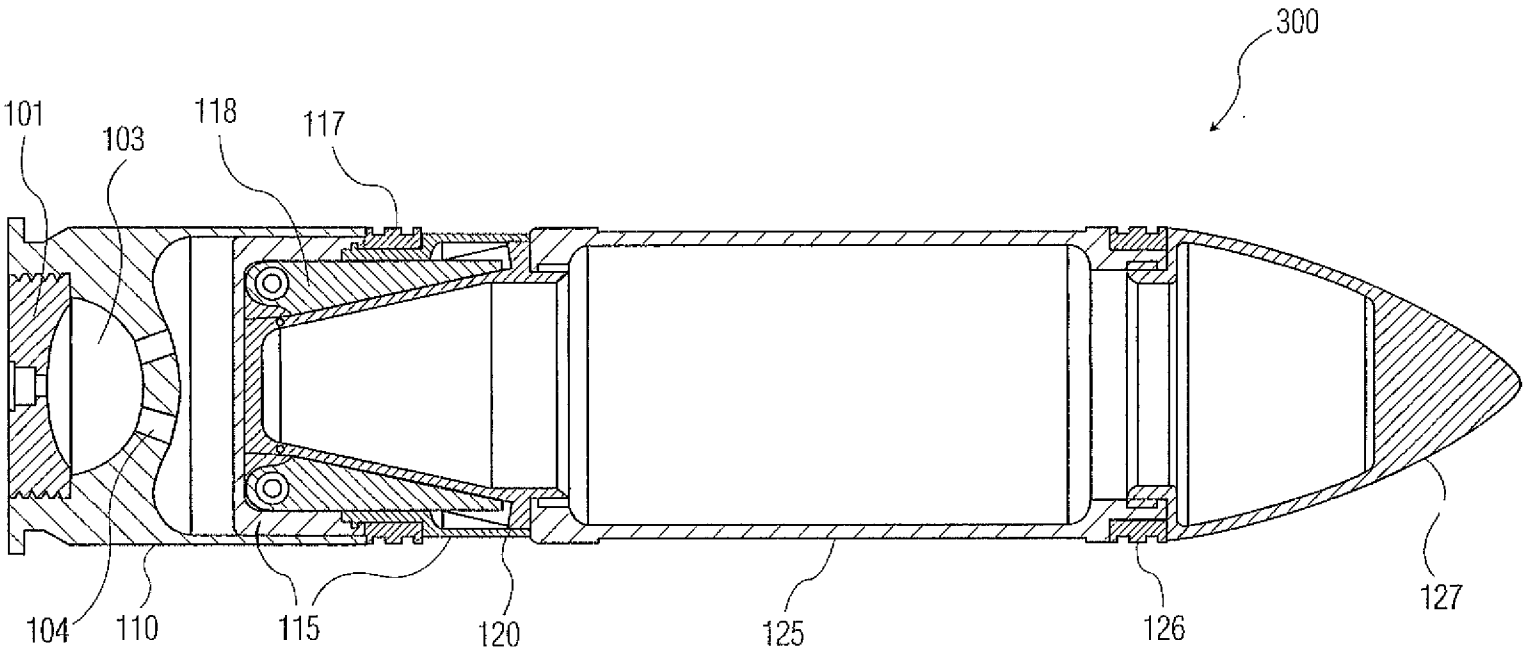
FIG. 4 shows a cutaway model of the 40 mm novel training (re-useable) and tactical (guidance adaptable) 40 mm projectile cartridge of FIG. 3, according to this invention.

FIG. 1 is an exploded view of a novel training (re-useable) and tactical (guidance adaptable) 40 mm projectile assembly (100). This projectile assembly/cartridge (100) comprises components of: a base plug (101), a propellant holding cup (102), a cartridge case (110), a rear holding cup assembly (115), a rear obturator (117) which sits in rear obturator seat (305), a tail assembly (120), a projectile body (125), a front obturator (126) which can spin freely when installed in a front obturator seat on the projectile, and a nose (127). The obturators are usually installed by snapping together the round; they are right in perfect position, also they are absolutely free to spin, independently of any other parts of the round. As shown in FIG. 2, The cup has venting holes 308 in its back panel 306. These are to allow the cup to be pressurized as the projectile goes up the gun tube. The constant pressure of the propellant gasses keep the cup pressed up against the in-flight projectile. Once outside the gun tube there are no more propellant gasses pushing the projectile. The pressure inside the cup now pushes it away from the projectile, allowing the fins to deploy. The front of the cup may have grooves cut to reduce the friction of the cup on the body of the in-flight projectile. This allows for an even easier separation and allows the cup to spin freely of the in-flight projectile. If any gasses get past the grooves in the front of the cup, the second obturator in front of the cup contains the gases and prevents blow by of the gases past the obturator. The cup is made in two parts. This allows for the rear obturator to be slid onto the obturator seat and function properly. Once the obturator is in place the cup is snapped together. There are two matching grooves (male/female) that allow the cup to snap together and function. The positioning of the both two obturator bands is exact and is needed to hold the projectile in true position so that the front end of the projectile never touches the rifling as it comes through the gun tube. Otherwise the round being so much longer than previous 40 mm projectiles, it might rattle as it travels up the tube and cause the round to spin if any part of the projectile, except for the obturators, touches the rifling, (and also cause propellant gas blow by too). The cup never touches the rifling because the obturators are larger diameter than any part of the cup. The number of venting holes 308 may be any quantity for operations, though six or more may be beneficial. The tail assembly 120 is covered by the rear holding cup assembly 115. The rear holding cup assembly 115 is attached to the rear of the front projectile where it is snapped on and may spin independently of the front projectile and other components, and as mentioned it also serves to cover over the tail assembly 120 there. The diameter of the holding cup assembly 115 is essentially the same as the diameter of the front projectile body 125, but by all means is it less than the diameter of the obturators 117,126 or even of the cartridge case 110. Both obturators are essentially of the same outside diameter, as mentioned, and the obturators are sized to fit within the launcher tube. To note, if the cup assembly were not attached to cover tail assembly 120, the fins might be engaged by the launcher tube rifling and either break off or spin up the projectile. And, if the projectile were to so then spin, it would also likely then tumble in flight. FIG. 2 shows the assembled view of the novel training (re-useable) and tactical (guidance adaptable) 40 mm projectile assembly (100), ready to be inserted into a cartridge case 110 (see also FIG. 3). FIG. 3 shows in-bore projectile (200) inserted into a cartridge case (110), then ready to be loaded into an M203 or M320 gun launcher barrel tube. When in-bore projectile (200) is inserted into the cartridge case, it becomes the novel training (re-useable), or tactical (guidance adaptable), 40 mm projectile assembly (100), and is ready to be fired in a M203 or M320 gun launcher. Cartridge (100) can be utilized in the M203 if the total overall length is less than approximately five inches. Longer cartridges up to eight inches (made longer by increased length of body (125) and/or nose (127)), can be shot from an M320. FIG. 4 shows a sectional view, a model of the assembled novel training (re-useable) and tactical (guidance adaptable) 40 mm projectile assembly (100). Cartridge (100) is assembled as follows. Fins (118) are assembled to the tail assembly and springs (not completely shown here) are added to ensure fins open after exit from gun tube. Rear obturator (117) is placed onto rear cup (115) and the cup assembly (115) which was originally in two parts is now snapped together into one piece, holding obturator (117) in the center as shown. The in-bore projectile (200) can now be assembled. A front obturator (126) is placed on the nose (127) and threaded into the body (125). The tail assembly (120) with fin and springs is then threaded into the body (125). The rear cup assembly (115) is then snapped onto the tail assembly (120). This completes the in-bore projectile (200). It is termed the "in-bore projectile" (200) because this projectile is what travels up the gun tube after propellant ignition. The in-bore projectile (200) is pressed into the cartridge case (110) up to the obturator (117). It is turned with cartridge case (100) at the top position facing up. Propellant closure cup (102) is placed into rear cavity of cartridge case (100) and propellant added (propellant not shown here). Base plug (101) is threaded or pressed into the rear of the cartridge case. This now becomes completed cartridge (100). Cartridge case (110) allows for substantially more propellant (about 1200 mg) than previously provided, to be utilized by these 40 mm low velocity projectiles and therefore achieving greater velocity for the projectiles. Thus, extended range can now be achieved by these previously lower velocity 40 mm projectiles. The shape/size/volume and free space were optimized by trial experiments to achieve the most optimized design, and shown here as cartridge case (110) with propellant closure cup (102) and base plug (101) completing the assembly. Testing has shown that the velocity can be safety increased on 40 mm in-flight low velocity projectiles, including in-flight projectile (400), from a service velocity of approximately 78 meters/second to a service velocity of approximately 125 meters/second utilizing the cartridge case (110) assembly. In-flight projectiles are considered defined as the projectile that flies from the gun exit, all the way to the target. Service velocity is considered defined as the velocity a projectile exits from the gun, when the ammunition is temperature conditioned to 70 degrees Fahrenheit. This velocity increase (78 meters/second to 125 meters/second), can translate to an increased range (extended range) in the 40 mm low velocity in-flight projectiles, from approximately 400 meters to over 700 meters depending on projectile length, weight and aero-ballistic shapes. This invention fills an important need.

There are currently no Canard Activation Systems (CAS) for a 40 mm projectile. Each CAS system is unique to the projectile it is used for. A spin stabilizer projectile in 40 mm will not work for this because the spin rate is changing every fraction of a second and true position cannot be found. In this invention, as this (non spinning) 40 mm projectile travels down range, directions of up, down and right, left will always be the same. (Larger projectiles in 60 mm and larger calibers have added space to tell true position, but the space and cost allowance for a 40 mm projectile make such prohibitive). This invention achieves launch without spin, therefore these advanced systems can now be added.

Figure 5:
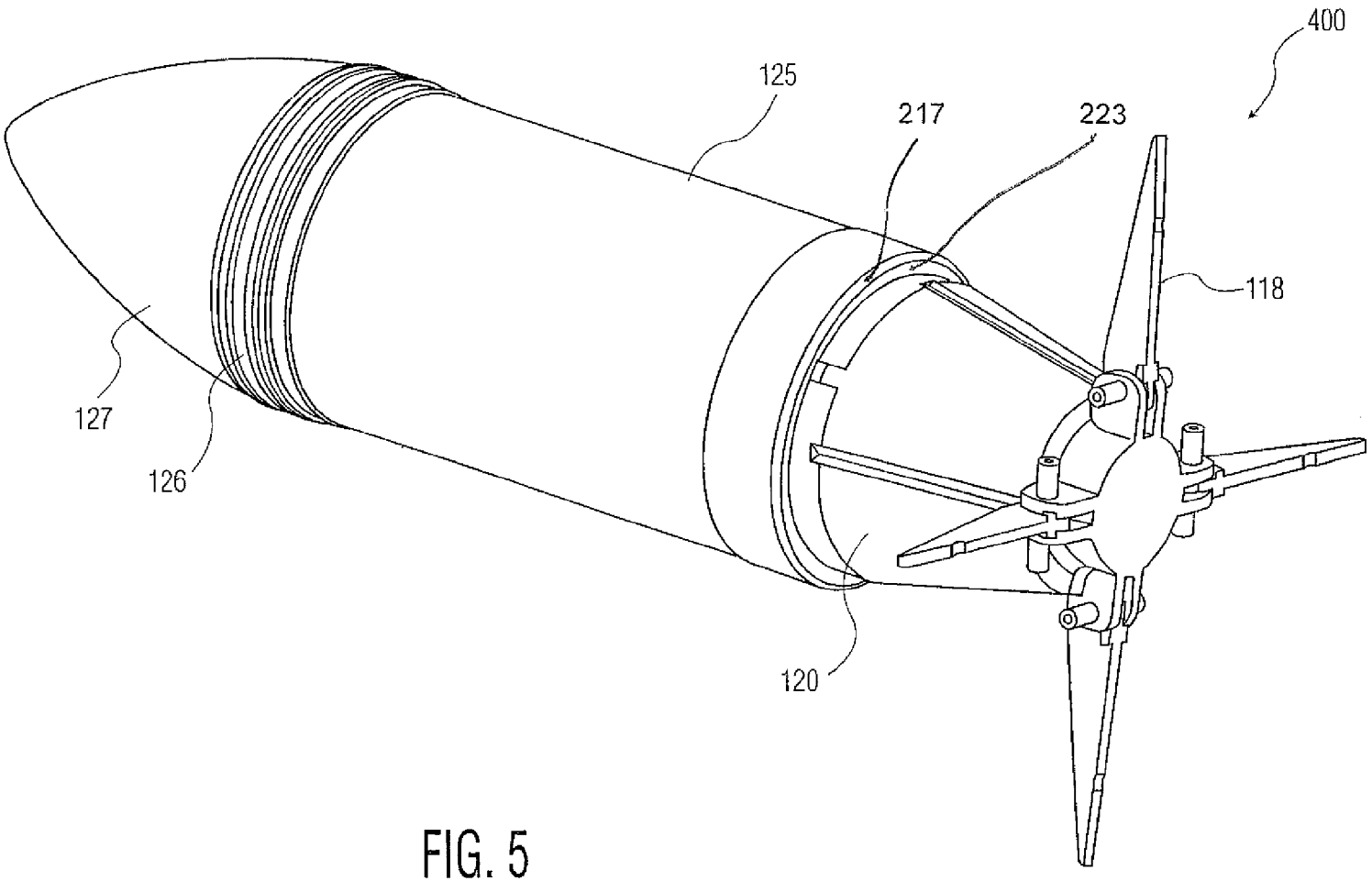
FIG. 5 shows a model of the 40 mm novel training (re-useable) and tactical (guidance adaptable) 40 mm in-flight projectile embodying rear fins, according to this invention.

FIG. 5 is a model of an in-flight projectile (400). The in-flight projectile comprises a nose (127), forward obturator (126), body (125), and tail assembly (120). The ballistic functioning of the novel training (re-useable) and tactical (guidance adaptable) 40 mm projectile assembly (100) is as follows. Cartridge (100), FIG. 3, is loaded into the M203 or M320, as designed to fit. The cartridge case (110) is held firmly in the gun chamber and the rear obturator (117) is pressed against the forcing cone or rifling area. When cartridge (100) is fired, the propellant gases burn through propellant closure cup and pass through the propellant vents (104). The gases expand and push in bore projectile (200), FIG. 2, through the barrel. The in bore projectile comprises: rear holding cup assembly (115), rear obturator (117), tail assembly with fins (120), body (125), forward obturator (126), and nose (127). The gun gases cannot get past the obturator (117) which deforms and forms a gas seal with the gun tube and rifling. Both the obturator (117) and the rear holding cup (115) assembly spin freely from the in-flight projectile, FIG. 5. While the rear holding cup assembly (115) mates with the back of the projectile tail assembly, at e.g., 217, 223 of FIG. 5, it is snapped on not solidly fastened there. The rear holding cup (115) assembly actually spins freely from the in-flight projectile since it is not completely attached, only snapped onto it as a kind of joint which allows relative rotation to be unimpeded, at the forward part of the tail assembly (120). The rear holding cup (115) assembly may be held by several elevated bump grooves that allow the cup (115) to rotate freely, without the projectile also rotating. Since the obturator (117) is loosely attached to the cup (115) in its obturator seat 305, it spins freely as well. Likewise, the front obturator 126 is free to spin independently in its obturator seat. As mentioned, the cup and projectile has/have a smaller diameter than the obturators or the cartridge case, (which projectile diameter is also smaller than the internal diameter of the launcher tube) so the projectile is not independently engaged by the grenade launchers' internal rifling to be able to be spun. And as mentioned, the cup assembly is internally pressurized in flight through venting holes 308. Upon exit from the gun, this pressure tends to help blow off/expel the cup assembly (115) so the cup and rear obturator (117) can no longer hold onto the tail assembly (120). The in-flight projectile separates from the cup and rear obturator (117). The spring loaded fins (118), which were held closed by the cup (115) now open up. The in-flight projectile (tail assembly (120), spring loaded fins (118), body (125), optional front obturator (126) and nose (127)) continues onto target while the cup and rear obturator (117) eventually hit the ground. The in-flight projectile has little or no spin and is stabilized during its flight by the pop open fins (118). As mentioned, the improved cartridge case (110), allows for more propellant to be held than found with the current 40 mm low velocity cartridge case. Due to the increased propellant load (greater than 50%), efficiency increase of propellant burn due to the shape of, and increased capacity (1200 mg approximately versus only 100 mg in the conventional M433 projectile shot from one of these grenade launchers), the performance is increased. Also of note, the propellant holding cup (102), bowl (103) and propellant vents (104), and the in-flight projectile aerodynamic shape including the fins, the increase in velocity (from 78 meters/sec to 120 meters/sec) translates to an increase in range from approximately 400 meters to over 600 meters. The fins provide increased aerodynamic stability and are not present on any current low velocity 40 mm projectiles due to the technical challenges that this invention has overcome. In addition, while standard 40 mm low velocity projectiles are only accurate out to approximately 300 m, this novel in-flight projectile (400), is accurate out to over 600 meters, without guidance navigation and control components. But, with addition of a canard activation system (CAS), which provides guidance navigation and control components, one can add extended range and accuracy to over 1000 meters. When the cartridge (100) is used as a training round, the nose (127) and body (125) are made of plastic and filled with fluorescent dye powder (not shown). Upon target or ground impact the plastic breaks and the dye comes out as a cloud imitating an explosion. If the training is for target training only, the nose (127) and body (125) are made of metal and are not filled. If a soft catch is used at the target sight then the projectile can be reused. Testing has successfully reused the soft catch projectiles up to 6 times. If the cartridge (100) is intended for tactical use, the nose (127) and body (125) are made of metal and are filled with explosive, warhead and shaped charge liner. Expensive flutes on the shape charge are not needed since the tactical in-flight projectile (400), has little or no spin. The exterior shape of each of the three afore mentioned projectiles are the same. The shape, weight and center of gravity (CG) are kept similar for all three in-flight projectile (400) by adjusting the thickness of the plastic or metal of the nose (127) and body (125). Therefore, all three aforementioned in-flight projectiles (400), will have similar flight profiles, given the same muzzle velocity and temperature conditioning of the projectile. For the tactical version of the in-flight projectile (400), increased lethality (compared to the current 40 mm low velocity) is achieved through increased precision and accuracy on targets and increased projectile length for more fragments and increased amount of explosive/energetic.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention. The invention for example could be used on grenade launchers other than an M320, including stand alone devices to receive a grenade launcher, other types of shoulder launched weapons, or weapons other than grenade launchers, and for ammunition other than necessarily the caliber or types shown here, where the principles of the invention might be beneficially employed.

What is claimed is:

1. In an ammunition round, a full in-bore 40 mm projectile configured for firing from an M203 or and M320 grenade launcher without incurring any spin on said projectile imparted by said M203 or M320 grenade launcher during launching, the projectile comprising:

a projectile body having a diameter; a nose section; and a stabilizing folded aft tail assembly attached at the rear of the projectile body wherein the folded tail assembly is configured to unfold in flight after launching;

the projectile further including a rear holding cup assembly attached to the projectile body via a snapped on, spinnable connection, the rear holding cup having the same outside diameter as the projectile body, wherein the rear holding cup assembly cups over said folded aft tail assembly, the rear holding cup assembly further including a free spinning rear obturator thereon and a rear closure thereon, the rear closure having venting holes therein;

the projectile further includes a free spinning front obturator on the projectile body and a rear cartridge case attached to the rear holding cup assembly; wherein the outside diameter of the holding cup assembly and the projectile body are less than the outside diameters of the front and rear obturators and of the rear cartridge case;

wherein during launch of the projectile, the rear holding cup assembly becomes internally pressurized through the venting holes and wherein upon exit of the projectile from the launcher, the rear holding cup assembly is expelled off of the folded aft tail assembly to allow said folded aft tail assembly to unfold.

2. The ammunition round of claim 1 wherein the stabilizing folded aft tail assembly comprises fins that are spring loaded.

3. The ammunition round of claim 1 wherein the number of venting holes are at least six.

4. The ammunition round of claim 1 wherein said rear cartridge case further includes a propellant holding cup, and a base plug.

5. The ammunition round of claim 1 wherein the nose section comprises a tactical guidance having guidance navigation and a control canard activation system added between the body and nose.

6. The ammunition round of claim 1 having an explosive payload in the body and nose which includes any of: selected energetic materials, an explosive liner, fragmentation projectiles or a selected warhead.

7. The ammunition round of claim 1 used/reused for target training with fluorescent powder in the body and nose, imitating an explosion and tactical use.

8. The ammunition round of claim 1 wherein the snapped in, spinnable connection between the projectile and rear holding cup assembly is held by several elevated bump grooves.

9. The ammunition round of claim 2 where blades on said fins have a canted angle to relatively slowly spin up the projectile during firing.

* * * * *